US006857916B1

(12) United States Patent
Huang

(10) Patent No.: US 6,857,916 B1
(45) Date of Patent: Feb. 22, 2005

(54) CONTACT ASSEMBLY WITH NON-COPLANARITY ARRANGEMENT

(75) Inventor: Mao Jung Huang, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 10/763,199

(22) Filed: Jan. 26, 2004

(51) Int. Cl.[7] ..... H01R 13/02
(52) U.S. Cl. ..... 439/885; 439/862
(58) Field of Search ..... 439/885, 606, 439/722, 736, 862

(56) References Cited

U.S. PATENT DOCUMENTS 5,116,237 A * 5/1992 Loewen ..... 439/326
5,788,544 A * 8/1998 Drekmeier et al. ..... 439/885

* cited by examiner

*Primary Examiner*—Tho D. Ta
(74) *Attorney, Agent, or Firm*—Rosenberg, Klein & Lee

(57) ABSTRACT

The present invention provides a contact assembly with non-coplanarity arrangement which includes a plurality of contacts and a contact belt. The contacts are stamped integrally in a piece of sheet metal. Each contact forms a solder portion, a connected portion and a conductive portion. The solder portions are aligned side by side and join the terminal belt as a whole. Each of the connected portions is extended from a free end of the solder portion. The conductive portions are aligned an arc shape and define a connecting end in one end thereof for joining integrated with the connected portion. As assembling, the plurality of contacts are assembled in a light pen as whole by once manipulation action.

4 Claims, 4 Drawing Sheets

CONTACT ASSEMBLY WITH NON-COPLANARITY ARRANGEMENT

BACKGROUND OF THE INVENTION

1. Field of the Invention

The present invention relates generally to an integral forming contact assembly, and especially to an integral forming contact assembly which is arranged non-coplanarity in an electronic apparatus.

2. The Related Art

At present, more and more users adopt a light pen as a presentation device in view of a convenient manipulation and application thereof without a space limit.

In general, a light pen has a pen body with an arc appearance. When manufacturing, it is necessary to provide a plurality of charging terminals which are arranged to form an arc shape and engaged electrically a plurality of connectors to charge for the light pen. In general, each charging terminal is stamped singly, then assembled respectively in the light pen one by one. In this consequence, the prior art mentioned above has some serious drawbacks. It results in a difficult assembly of the charging terminals and increases an assembling cost simultaneously.

SUMMARY OF THE INVENTION

Thus, an objection of the present invention is to provide a contact assembly with non-coplanarity arrangement, which simplifies a assembling manipulation of the charging terminals and decreases the assembling cost simultaneously.

To attain the above objection, the present invention provides a contact assembly with non-coplanarity arrangement, which comprises a plurality of contacts and a contact belt. The contacts are stamped integrally in a piece of sheet metal. Each contact forms a solder portion, a connected portion and a conductive portion. The solder portions are aligned side by side and join the terminal belt as a whole. Each of the connected portions is extended from a free end of the solder portion. The conductive portions are aligned an arc shape and define a connecting end in one end thereof for joining integrated with the connected portion.

As mentioned above, the plurality of contacts of the present invention are stamped with an integral whole. When the contacts are utilized in a light pen as charging terminals, they are assembled by once manipulation action. Thereby, the assembling manipulation of the charging contacts is simplified and the assembling cost is decreased simultaneously.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 1:
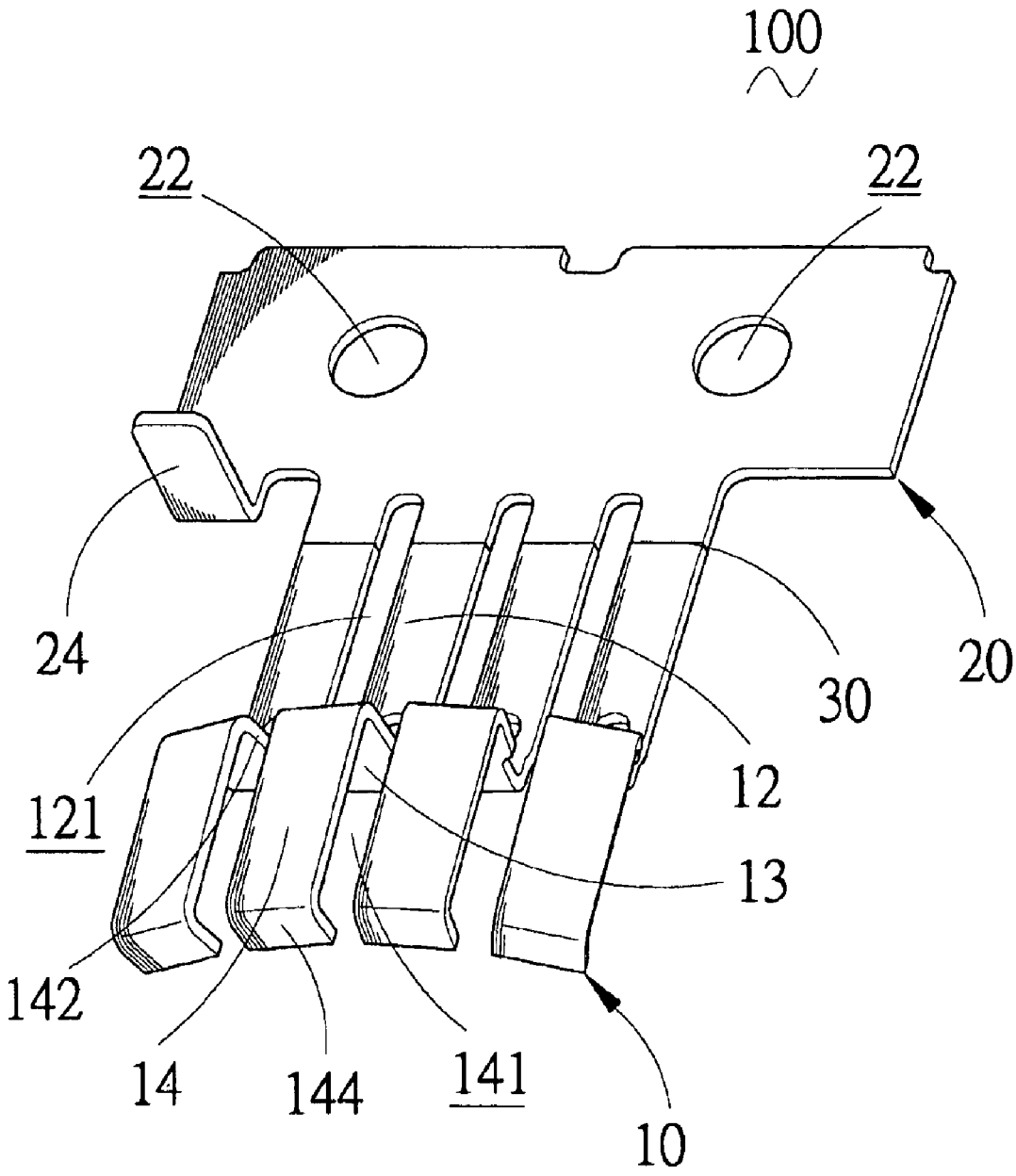
FIG. 1 is a perspective view of a contact assembly with non-coplanarity arrangement in accordance with the present invention.

With reference to the FIG. 1, a contact assembly with non-coplanarity arrangement, in accordance with the present invention, generally designed with reference numeral 100, comprises a plurality of charging contacts 10 and a contact belt 20. The contacts 10 are stamped integrally in a piece of a sheet metal. The contact belt 20 is formed from the sheet metal and joins the contacts 10 as a whole.

Each of the contacts 10 has a solder portion 12. The solder portions 12 are aligned side by side and extended horizontally forward from one side of the contact belt 20. A break line 30 is formed between the solder portion 12 and the contact belt 20. The solder portion 12 extends upward a connected portion 13 from a free end thereof. The connected portion 13 extends forward a conductive portion 14 from a free end thereof. One end of the conductive portion 14 defines a connecting end 142 to join the connected portion 13 as a whole and the other end forms a locking end 144. When the contact assembly with non-coplanarity arrangement 100 is assembled in a light pen 1, a firmly interlocking therebetween is achieved through an interconnection between the locking end 144 and a pen body 200 of the light pen 1. In addition, the contacts 10 closed each other define a first and a second interval 121, 141 between the solder portions 12 and the conductive portions 14 respectively wherein the first interval 121 is smaller than the second interval 141.

The contact belt 20 is stamped to form a pair of positioned holes 22 in each side of a middle part thereof. On a process of the contacts 10 being stamped, a steady and uniform contact interval is achieved by a design of the positioned holes 22. Meanwhile, the contact assembly with non-coplanarity 100 is taken out after the contacts 10 being stamped. Because the solder portion 12 of the contact 10 is lower than the conductive portion 14, the contact belt 20 is easy to become inclining. So that, the contact belt 20 further extends upward a fixed portion 24 from a corner thereof to avoid an inclining condition described above.

Figure 2:
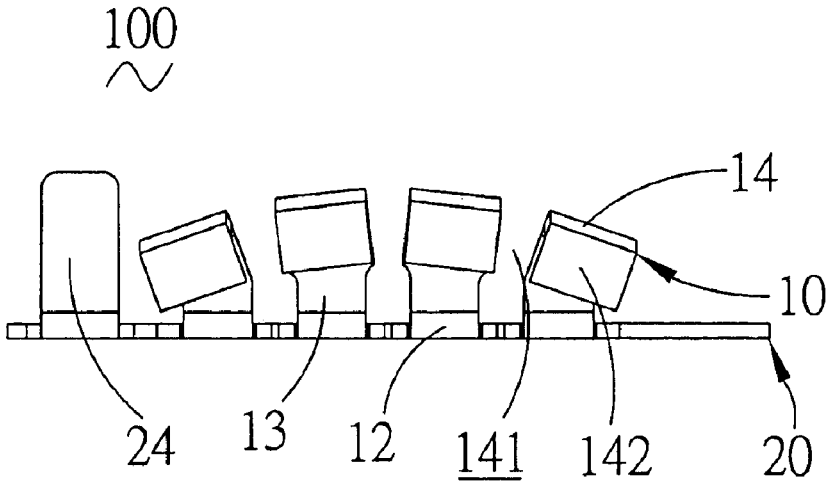
FIG. 2 is a front view of the contact assembly with non-coplanarity arrangement shown in FIG. 1.
Figure 3:
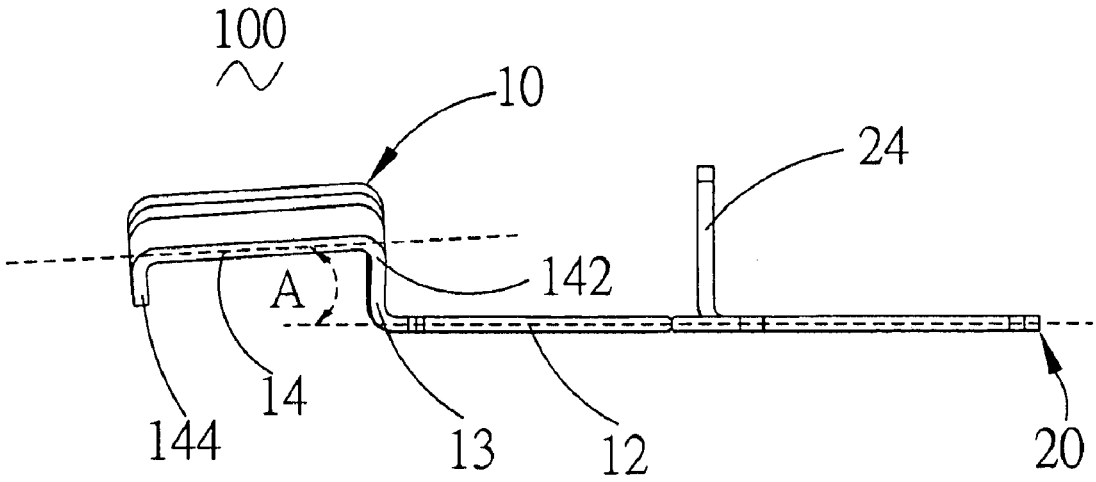
FIG. 3 is a right view of the contact assembly with non-coplanarity arrangement shown in FIG. 1.

FIGS. 2 and 3 together, in order to mate an arc appearance design of the light pen 1, the conductive portions 14 of the plurality of contact 10 are aligned to form an arc shape. Moreover, the conductive portions each 14 are inclined downward along a direction from the connecting end 142 to the locking end thereof, so that an appropriate angle A is defined between a plane of each conductive portion and a plane of each correspondingly solder portion, as represented in FIG. 3 by broken lines.

Figure 4:
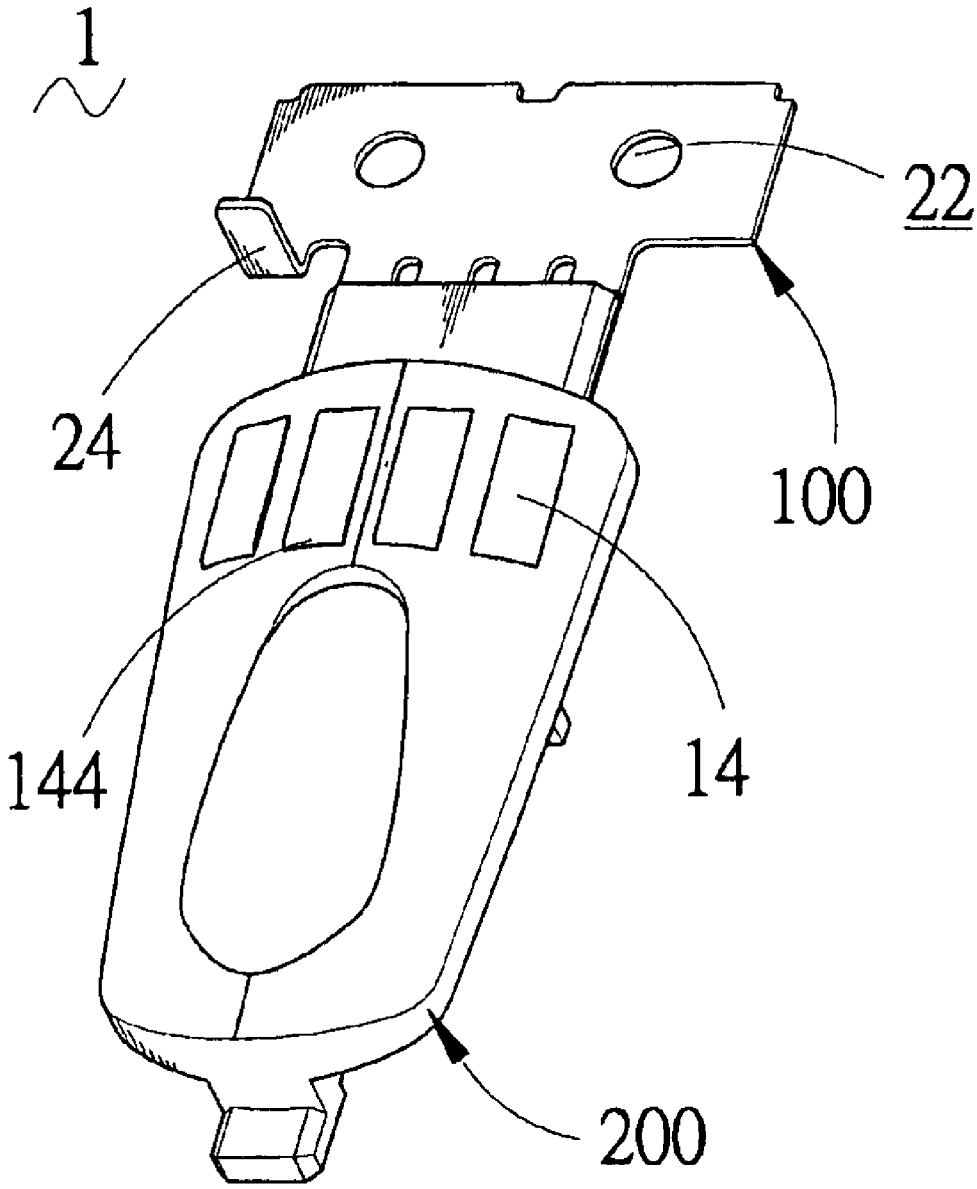
FIG. 4 is a downward perspective view showing a status of the contact assembly with non-coplanarity arrangement assembled in a light pen.
Figure 5:
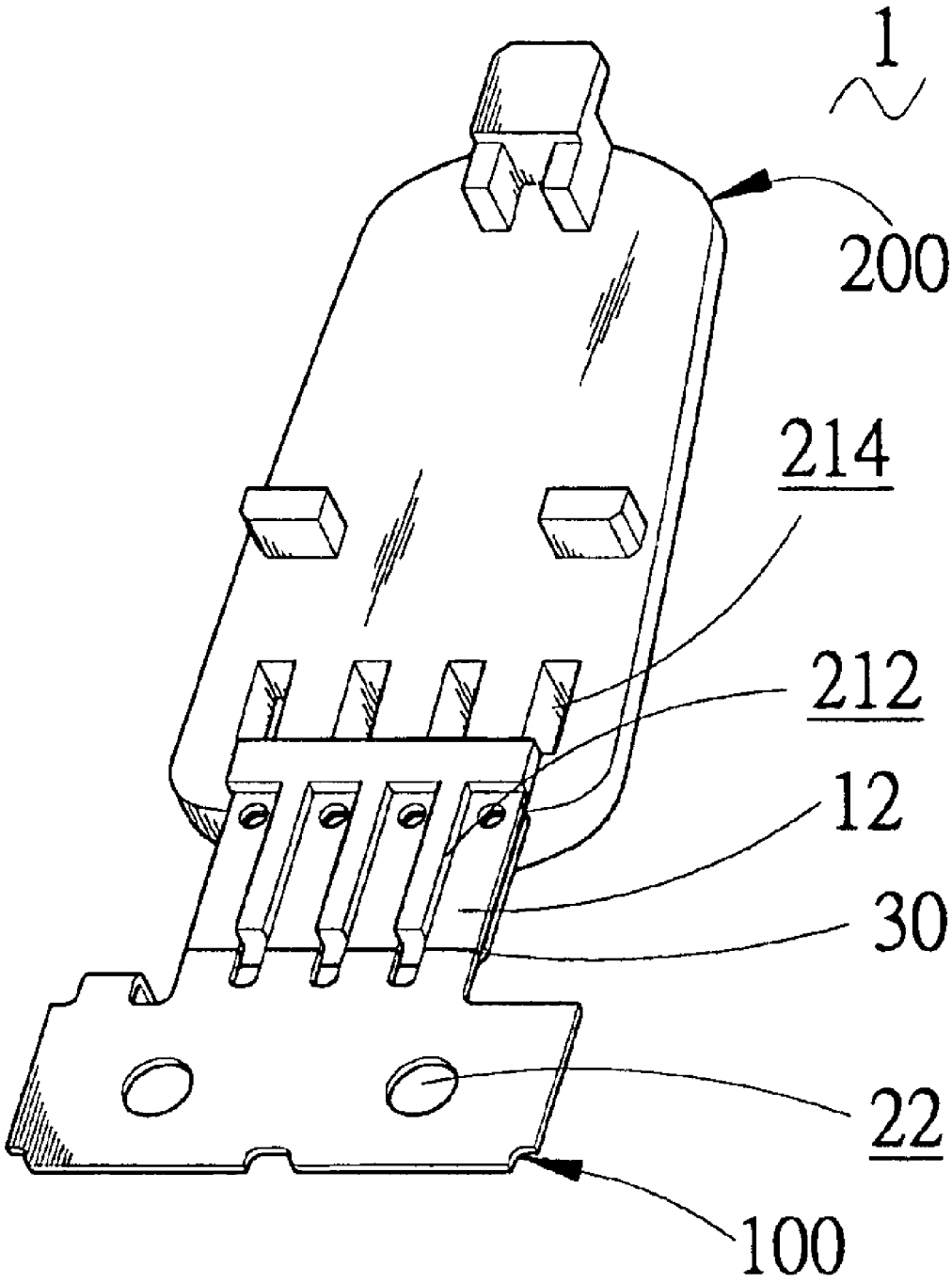
FIG. 5 is an upward perspective view showing a status of the contact assembly with non-coplanarity arrangement assembled in the light pen.

Now referring to FIGS. 4 and 5, the light pen 1 includes the light body 200 mounting the contact assembly with non-coplanarity arrangement 100 therein. The light body 200 opens a plurality of upper and lower received grooves 214, 212 in an arc upper surface and a rectangular lower surface respectively. The upper received grooves 214 receive correspondingly the conductive portions 14 of the contacts 10. The lower received grooves 212 receive correspondingly the solder portions 12 of the contacts 10.

In the embodiment illustrated, the contact assembly with non-coplanarity arrangement 100 and the pen body 200 are assembled integrally with the insert-molding method. The conductive portion 14 of the contact 10 protrudes slightly from the upper received groove 214 and is capably of conducting electrically power contacts of a mated connector to charge for the light pen 1. The solder portion 14 of the contact 10 is capably of engaging a printed circuit board (PCB) of the light pen 1. In addition, after the contact assembly with non-conplanarity arrangement 100 are assembled in the light pen 1, the contacts 10 is separated from the contact belt 20 by a break action along the break line 30, and the whole assembling manipulation is finished.

As mentioned above, the contact assembly with non-coplanarity arrangement 100 of the present invention forms the plurality of charging contacts 10 with an integral whole. When the contacts 10 are utilized in the light pen 1, they are assembled therein by once manipulation action. Thereby, the assembling manipulation of the contacts 10 is simplified and the assembling cost is decreased simultaneously.

Although a particular embodiment of the invention has been described in detail for purposes of illustration, additional advantages and modifications will readily appear to those skilled in the art, and various modifications and enhancements may be made without departing from the spirit and scope of the invention. Accordingly, the invention is not to be limited except as by the appended claims.

What is claimed is:

1. A contact assembly with non-coplanarity arrangement comprising:

a plurality of contacts stamped integrally in a piece of sheet metal, each contact being formed by a solder portion extending to a connected portion and a conductive portion extending from the connected portion, the solder portions of the plurality of contacts being aligned side by side, the connected portions each being extended upward from a free end of a respective solder portion, the conductive portions of the plurality of contacts being aligned to together define an arc shaped envelope; and a contact belt removably joined to the solder portions of the plurality of contacts.

2. The contact assembly with non-coplanarity arrangement as claimed in claim 1, wherein the conductive portion of the contact forms a locking end in the other end thereof, when the contact is assembled in a light pen, a firmly interlocking therebetween is achieved through an interconnection between the locking end and a pen body of the light pen.

3. The contact assembly with non-coplanarity arrangement as claimed in claim 1, wherein the conductive portion of the contact is inclined downward along a direction from the connecting end to the other end thereof, so that an angle is defined between a plane of each conductive portion and a plane of each correspondingly solder portion.

4. The contact assembly with non-coplanarity arrangement as claimed in claim 1, wherein a spacing between the contacts is defined by a first interval between the solder portions and a second interval between the conductive portions, the first interval being smaller than the second interval.

* * * * *